US007837287B2

(12) United States Patent
Verhoest et al.

(10) Patent No.: US 7,837,287 B2
(45) Date of Patent: Nov. 23, 2010

(54) SEGMENTED RECEIVER TABLE AND THROW DISTANCE CALIBRATION FOR A DIGITAL PRINTER

(75) Inventors: Bart Verhoest, Niel (BE); Luciaan De Coux, Heist o/d Berg (BE); Dirk De Ruijter, Deurne (BE)

(73) Assignee: Agfa Graphics NV, Mortsel (BE)

( * ) Notice: Subject to any disclaimer, the term of this patent is extended or adjusted under 35 U.S.C. 154(b) by 475 days.

(21) Appl. No.: 11/919,280

(22) PCT Filed: May 5, 2006

(86) PCT No.: PCT/EP2006/062087

§ 371 (c)(1),
(2), (4) Date: Oct. 24, 2007

(87) PCT Pub. No.: WO2006/120167

PCT Pub. Date: Nov. 16, 2006

(65) Prior Publication Data

US 2009/0051715 A1 Feb. 26, 2009

Related U.S. Application Data

(60) Provisional application No. 60/701,378, filed on Jul. 21, 2005.

(30) Foreign Application Priority Data

May 9, 2005 (EP) ..... 05103836
May 24, 2005 (EP) ..... 05104414

(51) Int. Cl.
*B41J 25/308* (2006.01)

(52) U.S. Cl. ..... 347/8

(58) Field of Classification Search ..... 347/8, 347/104, 164, 242; 271/30.1, 217; 400/55–60
See application file for complete search history.

(56) References Cited

U.S. PATENT DOCUMENTS

| | | | | |
|---|---|---|---|---|
| 5,121,169 | A | 6/1992 | Kawabata | |
| 6,168,259 | B1 * | 1/2001 | Capurso | 347/36 |
| 6,652,054 | B2 * | 11/2003 | Regev et al. | 347/8 |
| 2004/0017456 | A1 | 1/2004 | Obertegger | |
| 2008/0238995 | A1 * | 10/2008 | Menendez et al. | 347/37 |

FOREIGN PATENT DOCUMENTS

| | | | |
|---|---|---|---|
| DE | 3429188 | A1 | 2/1986 |
| EP | 0336870 | B1 | 6/1993 |
| EP | 1721749 | A1 | 11/2006 |
| EP | 1721750 | A1 | 11/2006 |
| EP | 1721751 | A1 | 11/2006 |
| JP | 58160173 | | 9/1983 |
| WO | WO 2006/120163 | | 11/2006 |
| WO | WO 2006/120164 | | 11/2006 |
| WO | WO 2006/120166 | A1 | 11/2006 |

* cited by examiner

*Primary Examiner*—Charlie Peng
(74) *Attorney, Agent, or Firm*—Keating & Bennett, LLP

(57) ABSTRACT

A receiver table (1) is provided for holding a receiver in a digital printer using a shuttle (2) carrying the printheads (3), e.g. an ink-jet printer, which is divided in small table segments (5) of which height and orientation can be adjusted. By adjusting the segments (5) the table (1) can be deformed to obtain a constant receiver-printhead distance even if the guidance of the shuttle (2) has deviations or exhibits bending during shuttling. Table segments (5) are preferably mounted on a deformable table support (13). The receiver-printhead "throw distance" can be calibrated by measuring the distance profile and adjusting adjustments screws or bolts to align the table segments (5) to the ideal printing distance.

9 Claims, 5 Drawing Sheets

SEGMENTED RECEIVER TABLE AND THROW DISTANCE CALIBRATION FOR A DIGITAL PRINTER

This application is a 371 National Stage Application of PCT/EP2006/062087, filed May 5, 2006. This application claims the benefit of U.S. Provisional Application No. 60/701,378, filed Jul. 21, 2005, which is incorporated by reference herein in its entirety. In addition, this application claims the benefit of European Application No. 05103836.2, filed May 9, 2005, and European Application No. 05104414.7, filed May 24, 2005, which are also incorporated by reference herein in their entirety.

FIELD OF THE INVENTION

The present invention relates to an receiver table in a printer. More specifically the invention is related an adjustable receiver table enabling calibration of printerhead-receiver distance

BACKGROUND OF THE INVENTION

Printing is one of the most popular ways of conveying information to members of the general public. Digital printing using dot matrix printers allows rapid printing of text and graphics stored on computing devices such as personal computers. These printing methods allow rapid conversion of ideas and concepts to printed product at an economic price without time consuming and specialised production of intermediate printing plates such as lithographic plates. The development of digital printing methods has made printing an economic reality for the average person even in the home environment.

Conventional methods of dot matrix printing often involve the use of a printing head, e.g. an ink jet printing head, with a plurality of marking elements, e.g. ink jet nozzles. The marking elements transfer a marking material, e.g. ink or resin, from the printing head to a printing medium, e.g. paper or plastic. The printing may be monochrome, e.g. black, or multi-coloured, e.g. full colour printing using a CMY (cyan, magenta, yellow, black=a process black made up of a combination of C, M, Y), a CMYK (cyan, magenta, yellow, black), or a specialised colour scheme, (e.g. CMYK plus one or more additional spot or specialised colours). To print a printing medium such as paper or plastic, the marking elements are used or "fired" in a specific order while the printing medium is moved relative to the printing head. Each time a marking element is fired, marking material, e.g. ink, is transferred to the printing medium by a method depending on the printing technology used. Typically, in one form of printer, the head will be moved relative to the printing medium to produce a so-called raster line which extends in a first direction, e.g. across a page. The first direction is sometimes called the "fast scan" direction. A raster line comprises a series of dots delivered onto the printing medium by the marking elements of the printing head. The printing medium is moved, usually intermittently, in a second direction perpendicular to the first direction. The second direction is often called the slow scan direction.

The combination of printing raster lines and moving the printing medium relative to the printing head results in a series of parallel raster lines which are usually closely spaced. Seen from a distance, the human eye perceives a complete image and does not resolve the image into individual dots provided these dots are close enough together. Closely spaced dots of different colours are not distinguishable individually but give the impression of colours determined by the amount or intensity of the three colours cyan, magenta and yellow which have been applied.

In order to improve the veracity of printing, e.g. of a straight line, it is preferred if the distance between dots of the dot matrix is small, that is the printing has a high resolution. Although it cannot be said that high resolution always means good printing, it is true that a minimum resolution is necessary for high quality printing. A small dot spacing in the slow scan direction means a small distance between marker elements on the head, whereas regularly spaced dots at a small distance in the fast scan direction places constraints on the quality of the drives used to move the printing head relative to the printing medium in the fast scan direction.

In order to move over a receiver in the fast-scan direction several printheads may be located on a single shuttle, moving over the receiver, guided on a guide rail. Generally, there is a mechanism for positioning the marker elements in a proper location over the printing medium before it is fired. Usually, such a drive mechanism is controlled by a microprocessor, a programmable digital device such as a PAL, a PLA, a FPGA or similar although the skilled person will appreciate that anything controlled by software can also be controlled by dedicated hardware and that software is only one implementation strategy.

One general problem of dot matrix printing is the formation of artefacts caused by the digital nature of the image representation and the use of equally spaced dots. Certain artefacts such as Moiré patterns may be generated due to the fact that the printing attempts to portray a continuous image by a matrix or pattern of (almost) equally spaced dots. One source of artefacts can be errors in the placing of dots caused by a variety of manufacturing defects such as the location of the marker elements in the head or systematic errors in the movement of the printing head relative to the printing medium. In particular, if one marking element is misplaced or its firing direction deviates from the intended direction, the resulting printing will show a defect which can run throughout the print. A variation in drop velocity will also cause artefacts when the printing head is moving, as time of flight of the drop will vary with variation in the velocity. Similarly, a systematic error in the drive system for moving the printing medium may result in defects that may be visible. For example, slip between the drive for the printing medium and the printing medium itself will introduce errors.

Especially in large size inkjet printers and industrial inkjet printing machines, the receiving medium transport system has to be very accurate and reliable in transport distance to avoid banding problems.

In certain printers the medium is held on a platen roller, usually having a relative large diameter, but such printers are restricted in the kind of media they are capable of handling. No relatively rigid media can be handled.

Another aspect in industrial printers is that the shuttle containing the printheads is usually relatively heavy in comparison to home or office printers. Due to the higher shuttle speed in industrial printers, the drops when release by an inkjet printhead follow a sloped path from the printhead to the receiver. Even the slightest deviation in throw distance, i.e. the distance between the head and the receiver will result in deviations in positioning the ink drops. In order to avoid misplacement of dots, the throw distance has to be kept constant over the full width of the shuttle and over the full length of the shuttle movement.

Also other recording processes need a constant printhead/receiver distance, e.g. to ensure equal impact along the pringting area.

Small printers usually have a single guide rail or two guide rails positioned on the same side. In industrial printers this give rise to problems as the shuttle, due to higher weight, generates considerable torque forces upon the guide rails as the heavy shuttle will deform the usually large size guide rails giving variations in the throw distance, resulting in problems for guarding recording quality.

Another well known aspect in digital printing is that the distance between printhead and receiver has to be adjusted to compensate for media thickness, in inkjet this is needed in order to keep the throw distance constant.

In EP 336 870 the position of a printhead is adjusted automatically or manually with respect to a platen roller in accordance with the thickness of a recording medium.

In a much more recent US 2004/17 456 several elements of the print engine, e.g. receiver table, printheads, shuttle, guide rails, can be adjusted likewise to compensate for media thickness.

However, adjustments of all these elements simultaneously makes adjustment difficult and may give rise to errors in positioning the printhead.

In US 2004/17 456 it is suggested to use a dynamic compensation device using a distance sensor to keep the throw distance constant, but is a complicated, expensive and relative unreliable method as it is an active method using moving parts.

The system also uses a total of four guide rails for carrying the printhead shuttle. This diminishes the problem of torque but even so the guide rails will slightly bend lowering the throw distance in the middle of the recording table.

A problem not recognised is that due to thermal expansion the shuttling system will develop strain resulting in deformations and probably inferior printing quality.

It is clear that there is still a need for improvement of large size printing systems to keep the printhead-receiver distance constant over the recording area.

SUMMARY OF THE INVENTION

The above-mentioned drawbacks are avoided by a adjustable receiver table system having the specific features set out in claim 1. Specific features for preferred embodiments of the invention are set out in the dependent claims.

A method for calibration of the local printhead-receiver distance is claimed in claim 8. Further preferred embodiments of the method are set out in the dependent claims.

Further advantages and embodiments of the present invention will become apparent from the following description and drawings.

DETAILED DESCRIPTION OF THE INVENTION

While the present invention will hereinafter be described in connection with preferred embodiments thereof, it will be understood that it is not intended to limit the invention to those embodiments.

The solution to the problem is provided by an adjustable receiver table assembly for holding the receiver during printing wherein the receiver table is segmented into table segments which are locally adjustable.

In order to more clearly indicate the advantages of the present invention, an overview of the problems of a digital printer such as a inkjet printer having one or more printheads in a shuttle moving over a receiver table is given.

Figure 1:
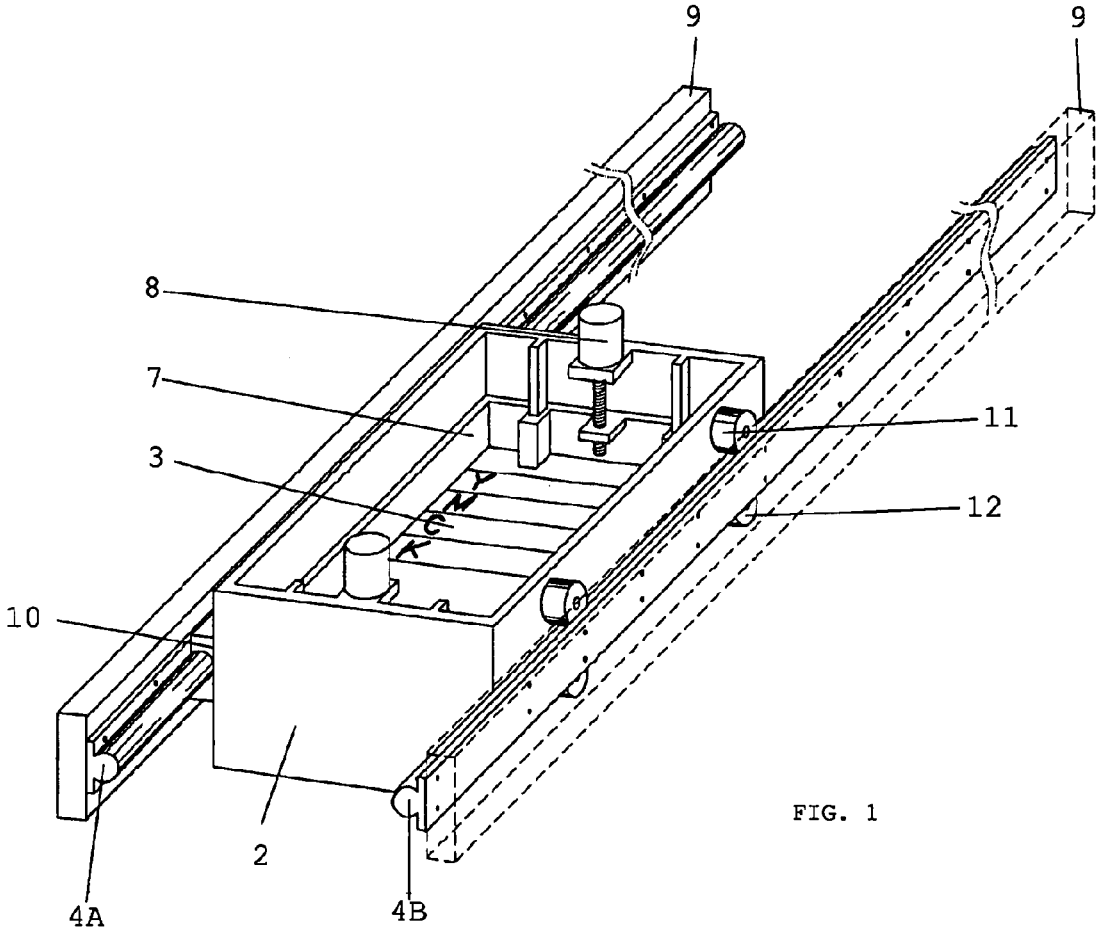
FIG. 1 illustrates the printhead shuttling mechanism suitable for use in the preferred embodiment of the invention.
Figure 2:
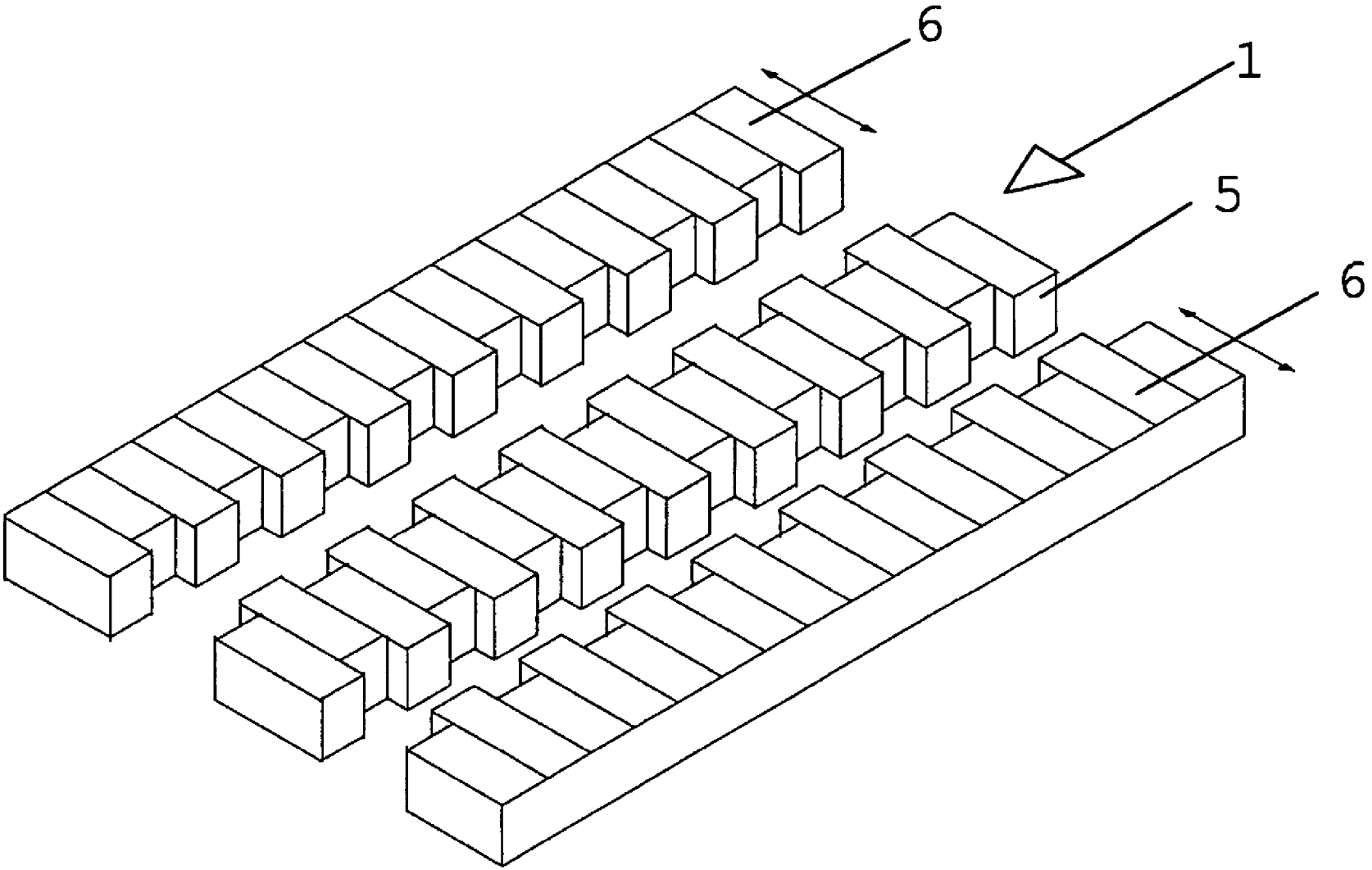
FIG. 2 depicts the principle of a central static segmented receiver table and dynamic tables.

Reference is made to FIGS. 1 and 2 depicting a printhead shuttling mechanism suitable for use in the preferred embodiment of the invention and a receiver table on which a receiver is positioned According to the invention there is provided a segmented static table 1 that holds the media (not shown) during a printing action when the shuttle 2 carrying the inkjet-printing heads 3 performs a fast scan along guide rails 4*a*, 4*b* over the receiving media as a swath is printed. During the printing action the whole working part of the receiving medium is thoroughly supported by the static table 1. Especially when using thin media this is important. No moving parts of the medium transport system are located under the working area. Only fixed parts are present under the working area. This means that the static table 1 has at least the width and the length to support the area of the receiving material on which the recording tool will operate, in this case an inkjet printheads 3 will record a swath of the image.

The receiving medium is therefore always held static during printing and a high accuracy in feeding the receiving medium in distance and orientation can be obtained leading to less artefacts in the printed image.

The forces for holding the receiving medium can be any sort of force but is preferable capable of being switched. The forces could be electrostatic, magnetic (certain media) or preferably vacuum.

Preferably a perforated top plate of the segments 5 of the receiver table 1 is provided which is connected to a vacuum chamber under the perforations. Table 1 and vacuum chamber form a closed box in which a vacuum can be created. Vacuum is applied and maintained by an air evacuation system, e.g. a ventilator system, drawing air out of the vacuum chamber to obtain a vacuum in the chamber.

To move the receiving material two dynamic suction tables 6 are provided which adhere to the receiver during receiver transport in between printing steps.

Now we take a closer look to shuttle guide mechanism and the problems associated with it.

The shuttle and shuttle guide mechanism comprise:

- shuttle 2 with printhead holder 7
- lift mechanism 8 to lift printhead holder 7 to adjust for media thickness of the receiving media.
- double beam 9 of the printhead frame
- guide rail 4 mechanism
- slide block 10 on one guide rail 4*a*
- cylindrical wheels 11 and counter-wheels 12 urged upwards to clamp the second guide rail 4*b*.

The double beam shuttle guide as depicted in FIG. 1 has several advantages over e.g. a single sided shuttle guide rail.

As the shuttle 2 is supported a each side, no torque forces are generated which could give a deviation and the printheads 3 will remain parallel to the receiver table 1.

Special elements avoid generation of strain and forces due to thermal expansion of the frame 9 and shuttle 2.

At the back side the shuttle 2 is mounted on the guide rail 4*a* using a sliding block 10. This allows for movement in the fast scan direction along the rails 4*a*, 4*b* but restrains the shuttle 2 in transverse and up and down direction avoiding bouncing and wobble of the shuttle on the rails 4*a*, 4*b*.

It is known that the guide rails 4*a*, 4*b* may have a deviation in the transverse direction of about 0.1 mm/m but this is an error to be discarded as it is the same for all marking elements or nozzles for all printheads 4 and thus can not be noticed by the human eye of the observer.

On the other rail 4*b* the shuttle 2 runs on cylindrical wheels 11 running on the round guide rail 4*b*. The wheels 11 are backed-up by counter-wheels 12 on the other side which are urged against the rail 4*b* thus preventing movement of the shuttle 2 in the vertical direction.

The system does allow free movement in the fast scan direction and gives room for slight transverse movement of the wheels 11,12 over the rail 4*b* due to thermal expansion avoiding strain an deformation of the system or transverse deviation of the rails 4*a*, 4*b*.

But the problem remains that the movement of the shuttle 2, weighing up to e.g. 50 kg, may cause:

bending of the frame 9 bending of the rails 4*a*, 4*b*

This may be a variable bending as the shuttle 2 moved over the trajectory from one side to the other side of the receiver table 1 in the printer.

The bending of the trajectory results in a slight forward tilting of the printheads 3 when moving the shuttle 2 from starting to centre point and a backwards tilting when moving from centre to end point of the trajectory. Tilting of the printheads 3 will give rise to variation in throw distance which will, due to the sloped path of the jetted drops, result in displace pixels.

As this tilting is not constant of the trajectory and the angle deviation is enhanced by the throw distance, this is a deviation which has to be avoided.

The same problem arises when the mounting of the rails 4*a*, 4*b* is not perfect and they both have simultaneous up and down deviations from the ideal perfectly horizontal path.

The line of writing elements of the printheads 3, e.g. nozzle of an inkjet printhead remain however parallel to the receiver.

A even more serious problem occurs when the rails 4*a*, 4*b* exhibit an unequal deviation from the ideal path.

one rail may have a greater bending than the other.

the mounting of the rails 4*a*, 4*b* is unequal.

This results is an angling of the printhead 3 sideways and a difference of the throw-distance of the nozzles at one side of the printhead 3 to the other side of the same printhead 3.

These deviations can not be corrected easily by simply moving the shuttle 2 or printheads 3 up and down.

A positive fact is that, although these deviation are local phenomena, these deviations are evolving gradually over the guide rails 4*a*, 4*b*.

It is the aim of the invention to keep the throw distance constant at all times. Therefore the receiver should follow the band of the imaginary surface having ideal throw distance or recording distance, i.e. it should follow up and down motions of the printheads 3 as the rails 4*a*, 4*b* bend or deviate and the receiver should be tilted if the shuttle 2 tilts due to unequal deviation of the guide rails 4*a*, 4*b*.

To obtain the substantially constant throw distance a special receiver table assembly is needed.

According to a preferred embodiment of the invention central to the system is an adjustable receiver table 1 assembly for holding a receiver during printing comprising a receiver table 1 which is segmented into table segments 5 wherein the table segments 5 are locally adjustable.

The table segments 5 of the receiver table 1 hold the receiver using e.g. vacuum forces. The top surface is formed by a rigid plates having small perforations of about 0.5 to 2 mm wide to enable the vacuum to attract the receiving medium lying above it during the printing action. Also small grooves (about 0.5 mm) are provided to distribute the vacuum over a larger area.

The perforations can also be replaced by small slits in the top plates.

Figure 3:
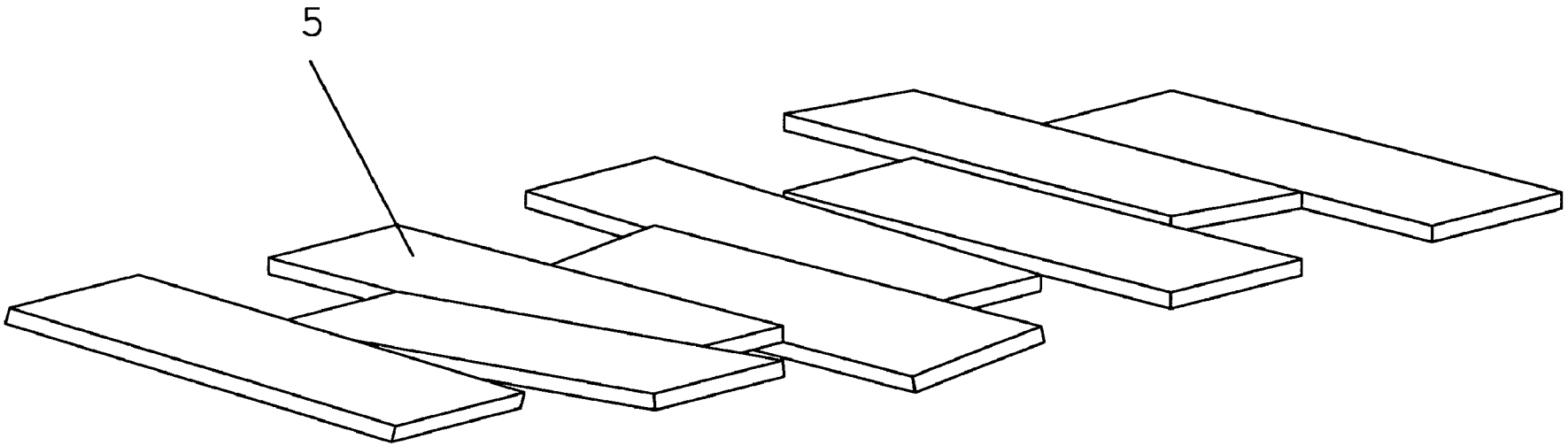
FIG. 3 depicts the principle of a receiver table having adjustable table segments.

As is illustrated, but greatly exaggerated in FIG. 3, the segments 5 of the static vacuum table 1 is adjustable in height at multiple locations so that it can conform to the height profile of the shuttle 2 and printhead 3 along the fast scan direction. In a preferred embodiment, the receiver table 1 is divided into multiple segments 5 along the fast scan direction. These segments 5 may individually be controlled at different heights. This provided optimum calibration of the distance between the printhead 3 or marking tool and the receiving medium, along successive sections of the fast scan movement.

Adjustment of the receiver table segments 5 may be in height to e.g. conform to bending of the shuttle frame 9 due to the weight, but preferably they are also adjustable in orientation to be able to tilt in order to comply with possible conditions wherein the printheads 3 are tilted along the guide path.

If e.g. multiple adjustment screws per table segment 5 are used, not only the average height of the table segment 5 but also the orientation of that table segment 5 may be adjusted. In a preferred embodiment the static table segments 5 may have a dimension, along the fast scan direction, in a range of a couple of cm up to tens of cm, depending on the targeted or required accuracy of the distance marking tool or printheads 3 to receiving medium.

Figure 4A:
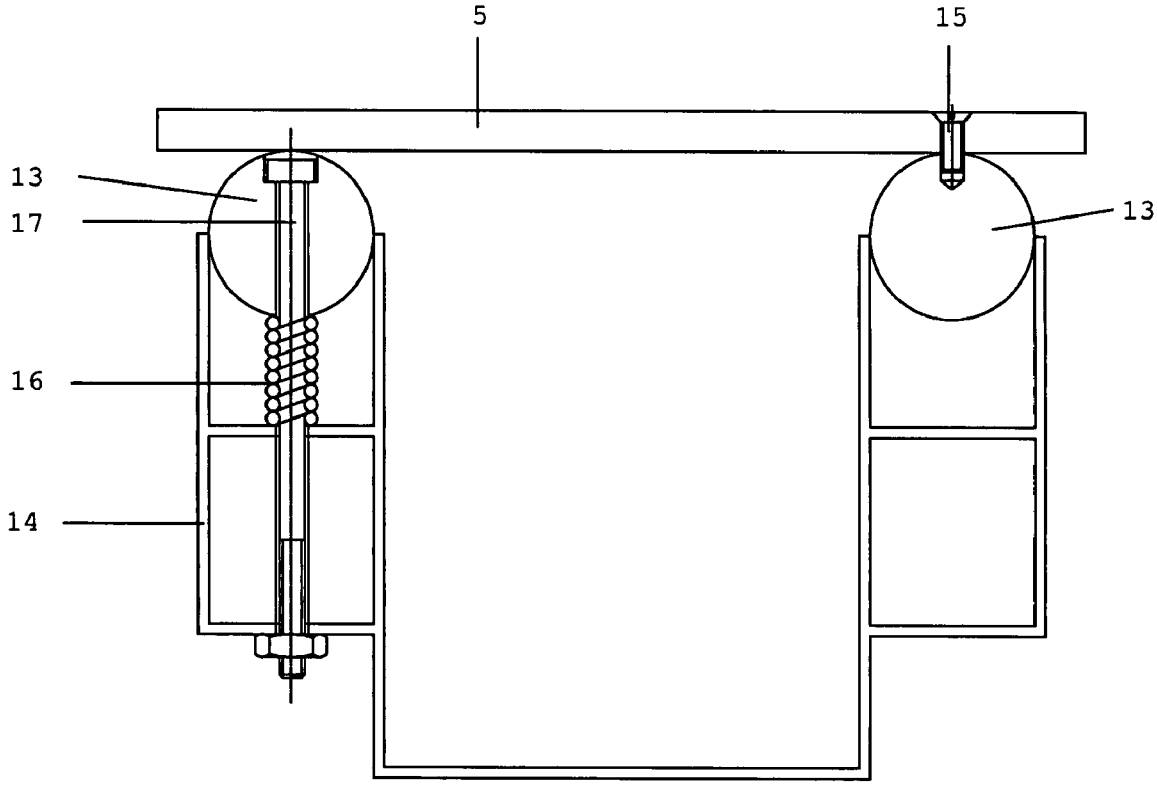
FIGS. 4A and 4B show an embodiment having a table support, mounted on a table frame, which is locally adjustable.
Figure 4B:
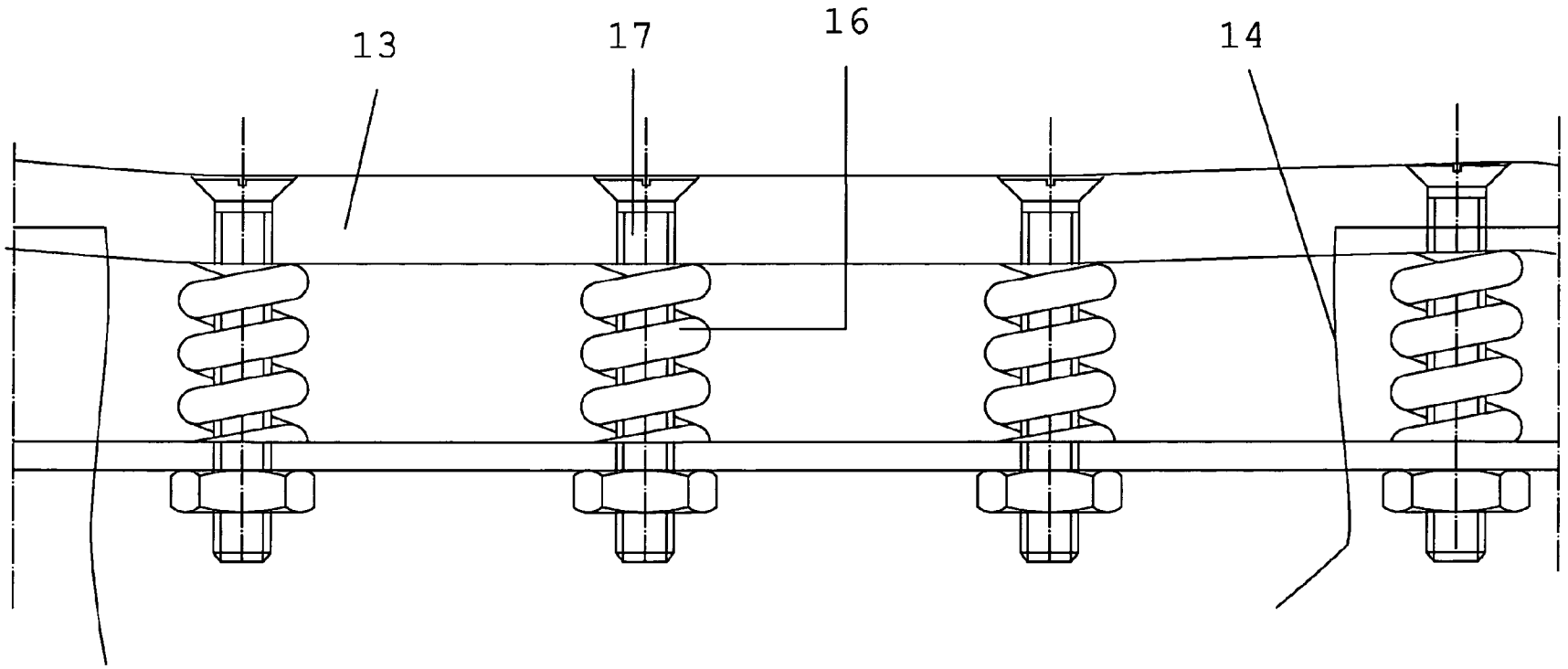

A preferred embodiment of a system for allowing adjustment of the table segments 5 is illustrated in FIGS. 4A and 4B.

To obtain a gradually evolving receiver table 1 the receiver table assembly preferable comprises:

a table support 13 for mounting the table segments 5 thereon wherein the table support 13 is a relative flexible mounting base for the table segments 5. The table support 13 can itself be deformed to conform with the undulating plane which is formed by the imaginary path followed by the writing end of the printheads 3.

The table support 13 itself is adjustably mounted on a rigid table frame 14 resisting any deformation. The table segments 5, unadjustabe mounted by e.g. mounting screws 15 located on the on the deformable table support 13 are this way adjusted to form thus together a relatively smooth plane following the ondulations of the ideal print plane.

As said the adjustments can be in height and orientation which may differ in the direction of the fast scan direction (climbing or descending) or in the transverse direction (sideways tilting).

The table support 13 is preferably a deformable table support bar 13 which is attached to the rigid table frame 14. The material and the diameter of the support 13 can be chosen to obtain certain parameters needed for the gradual deformation.

Although the table support 13 or table support bar 13 may be formed by several different sections, preferably the table support bar 13 is a contiguous bar along the table length.

Preferably two table supports 13 are provide to enable easy adjustment of the tilting of the table segments 5.

The adjustment of the table support bar 13 preferably is done using spring-biased calibration bolts 17 in between the table segments, but other method can be thought of.

As seen in FIGS. 4A and 4B the table support bars 13 are urged upwards by strong springs 16 but are withheld by adjustment bolts 17.

By adjusting the different bolts 17 along the two table support bars 13, these are deformed and the whole of the table segments 5 can be set to form a gradually evolving recording surface.

Also individually adjustment of the table segments 5 is possible, but this will make it more difficult to obtain a smooth receiver table 1.

Local printhead-receiver distance can be calibrated using the segmented receiver table 1 using the following method:

In a first step the distance profile of the receiver table 1 relative to the printhead position is measured resulting in distance profile data, Then the adjustment means 17 are adjusted thereby changing height or orientation of the table segments 5 to locally calibrate the printhead-receiver distance.

As adjustment of the table support 13 probably not only influences directly neighbouring table segments 5, but also has influence on other segments 5, it is preferred that the measurement and adjusting steps are repeated several times until an optimum distance profile is attained.

Measurement can be done by hand but preferably an automatic measurement device is provided possibly attached to the print shuttle 2.

The adjustment of the adjustment means 17 can be done by hand but preferably adjustment is done using an automated screw drive device acting upon the measured distance profile data.

Measurements can be done without a receiving material on the receiver table 1, but if the nature and properties of the receiving material, e.g. a stiff material strongly adhering to the receiver table 1 by vacuum, would influence the height and orientation of the table segments 5 during printing, a measurement can be done with a receiver present on the receiver table 1 and adjustment is done later without receiver.

A described above the height adjustment of the static table segments 5 may be realised by one or more height adjustment screws 17 per segment, or any other means known in the art for adjusting the height of the table segments 5.

Having described in detail preferred embodiments of the current invention, it will now be apparent to those skilled in the art that numerous modifications can be made therein without departing from the scope of the invention as defined in the appending claims.

REFERENCE NUMBERS

1 static receiver table
2 shuttle
3 printhead
4*a,b* guide rails
5 table segments
6 dynamic suction tables
7 printhead holder
8 lift mechanism
9 double beam printhead frame
10 slide block
11 cylindrical wheels
12 counter-wheels
13 table support
14 table frame
15 table segments mounting screws
16 springs
17 adjustment bolts or adjustment means

The invention claimed is:

1. A receiver table assembly for a digital printer including a printhead arranged to print an image on a receiver, the receiver table assembly arranged to hold the receiver during printing at a constant distance from the printhead during printing, the receiver table assembly comprising:

a static receiver table including a plurality of table segments; and a plurality of adjustment devices arranged to individually adjust both a height and a tilt of each of the plurality of table segments thereby adjusting both a distance and an orientation between the printhead and the receiver held on the static receiver table.

2. The receiver table assembly according to claim 1, further comprising:

at least one table support arranged to mount the plurality of table segments thereon; and at least one rigid table frame arranged to mount the at least one table support thereon; wherein a position of the at least one table support is arranged to be individually adjustable relative to the at least one rigid table frame by the plurality of adjustment devices so as to individually adjust the plurality of table segments.

3. The receiver table assembly according to claim 2, wherein the at least one table support includes a deformable table support bar attached to the at least one rigid table frame.

4. The receiver table assembly according to claim 3, wherein the deformable table support bar is a contiguous bar arranged along a length of the static receiver table.

5. The receiver table assembly according to claim 3, wherein the deformable table support bar is arranged to be adjusted by spring-biased calibration bolts.

6. A method for adjusting a distance between a printhead and a receiver in a digital printer, the digital printer comprising:

a printhead arranged to print an image on the receiver;

a receiver table assembly arranged to hold the receiver during printing at a constant distance from the printhead;

a static receiver table segmented into a plurality of table segments; and a plurality of adjustment devices arranged to individually adjust both a height and a tilt of each of the plurality of table segments;

the method comprising the steps of:

measuring a distance profile of the static receiver table relative to a position of the printhead to obtain distance profile data; and adjusting the plurality of adjustment devices to individually change both the height and the tilt of the plurality of table segments thereby changing the distance and an orientation between the printhead and the receiver held on the static receiver table.

7. The method according to claim 6, wherein the step of measuring a distance profile is performed using an automatic measurement device.

8. The method according to claim 7, wherein the printhead is mounted on a print shuttle arranged to shuttle over the static receiver table, and the automatic measurement device is attached to the print shuttle.

9. The method according claim 6, wherein the plurality of adjustment devices includes a plurality of adjustment bolts, and the step of adjusting the plurality of adjustment devices is performed using an automated bolt drive device based on the distance profile data obtained in the step of measuring the distance profile.

* * * * *